United States Patent [19]

Iwata

[11] Patent Number: 4,730,993

[45] Date of Patent: Mar. 15, 1988

[54] SQUEEZE PUMP

[75] Inventor: Noboru Iwata, Gifu, Japan

[73] Assignee: Daiichi Engineering Co., Ltd., Gifu, Japan

[21] Appl. No.: 866,826

[22] Filed: May 22, 1986

Related U.S. Application Data

[63] Continuation-in-part of Ser. No. 628,705, Jul. 9, 1984, Pat. No. 4,632,646, which is a continuation-in-part of Ser. No. 440,214, Aug. 2, 1982, Pat. No. 4,492,538.

[30] Foreign Application Priority Data

| | | | |
|---|---|---|---|
| Dec. 13, 1980 | [JP] | Japan | 55-176235 |
| Mar. 25, 1981 | [JP] | Japan | 56-44490 |
| Jul. 6, 1981 | [JP] | Japan | 56-105354 |
| Jul. 23, 1981 | [JP] | Japan | 56-116270 |
| Jul. 30, 1982 | [WO] | PCT Int'l Appl. | PCT/JP81/00364 |
| Dec. 30, 1985 | [JP] | Japan | 60-297234 |
| Dec. 30, 1985 | [JP] | Japan | 60-297235 |
| Jan. 13, 1986 | [JP] | Japan | 61-4660 |

[51] Int. Cl.[4] ..... F04B 43/12; F04B 15/02

[52] U.S. Cl. ..... 417/477; 417/900

[58] Field of Search ..... 417/476, 477, 900

[56] References Cited

U.S. PATENT DOCUMENTS

| | | | |
|---|---|---|---|
| 2,831,437 | 4/1958 | Cromwell et al. | 417/477 |
| 2,917,002 | 12/1959 | Mascaro | 417/477 |
| 4,221,543 | 9/1980 | Cosentino et al. | 417/477 |

FOREIGN PATENT DOCUMENTS

| | | | |
|---|---|---|---|
| 2040034 | 2/1972 | Fed. Rep. of Germany | 417/477 |
| 58-158389 | 9/1983 | Japan . | |

*Primary Examiner*—John J. Vrablik

*Attorney, Agent, or Firm*—Jordon and Hamburg

[57] ABSTRACT

A squeeze pump comprising: a casing having an arcuate inner peripheral surface; a resilient tube bent arcuately in the casing and having opposite ends projecting outwardly from the casing through openings therein; a rotary shaft disposed in an axis of the casing; and at least a pair of squeezing means mounted on the rotary shaft in the casing, the squeezing means including a pair of roller shafts extending perpendicularly to the rotary shaft, and a pair of squeeze rollers rotatably mounted on the respective roller shafts and rollable on opposite side surfaces of the resilient tube and revolvable at the same time about the rotary shaft for compressing the resilient tube from opposite sides thereof to transmit slurry in the casing, each of the squeeze rollers being divided along its axis into three independently rotatable roller sections, namely, a base end roller section constituting a base portion of the squeeze roller, a distal end roller section constituting a distal end portion of the squeeze roller, and an intermediate roller section constituting an intermediate portion between the base end roller section and the distal end roller section.

7 Claims, 12 Drawing Figures

SQUEEZE PUMP

REFERENCE TO RELATED APPLICATIONS

This is a continuation in part application of Ser. No. 628,705 filed on July 9, 1984, now U.S. Pat. No. 4,632,646 which in turn, is a continuation in part application of Ser. No. 440,214 filed on Aug. 2, 1982, now U.S. Pat. No. 4,492,538.

BACKGROUND OF THE INVENTION

1. Field of the Invention

The present invention relates to a squeeze pump for continuously transmitting a slurry such as nonhardened concrete containing aggregate.

2. Description of the Related Art

U.S. Pat. No. 4,492,538 was invented by the present inventor. In this squeeze pump, as reillustrated in FIGS. 8 and 9 of the accompanying drawings, a rotary shaft 53 is rotatably mounted centrally in a casing 52 in which a portion of a resilient tube 54 is disposed along an inner periphery of the casing 52 in such a manner that it extends in arc about the rotary shaft 53. Four roller shafts 56 are attached to the rotary shaft 53, and a cyindrical squeeze roller 57 is rotatably mounted on the distal end of each roller shaft 56. Since the squeeze rollers 57 rolls while compressing the resilient tube 54, the slurry in the resilient tube 54 is conveyed in the direction of rolling of the squeeze rollers 57.

However, such squeeze pump has a problem in that when it is operated for a long time, generation of heat would occur at portions where the resilient tube 54 contacts the squeeze rollers 57. It is viewed that this generation of heat results chiefly from frictional heat produced by the slipping between the squeeze rollers 57 and the resilient tube 54. This is because the individual squeeze roller 57 contacts the resilient tube 54 at the same peripheral speed through its entire roller length and hence tends to slip at any of its base, distal end and intermediate portions 57*a*, 57*b*, 57*c* with respect to the resilient tube 54 (FIG.10).

This generation of heat of the resilient tube 54 causes its components, such as rubber and reinforcing yarns, to be deteriorated, thus resulting in a shortened service life of itself.

In order to solve this problem, it is proposed in U.S. Pat. No. 4,492,538 that a taper roller of a diameter increasing gradually toward its distal end is used as each squeeze roller. With such taper squeeze rollers, however, the two roller shafts of each pair of coacting squeeze rollers must be mounted in non-parallel relation to each other, which is difficult.

Further, in the squeeze pump described in U.S. Pat. No. 4,492,538, as shown in FIG. 11, V-shaped valley 154 would be formed in the resilient tube 54 at its portion immediately ahead (upstream of the transmitting direction) of the rolling squeeze rollers 57. If the aggregate (in the slurry) is received in the corner 254 of the valley 154, the aggregate is hard to be advanced past the squeeze rollers 57. Therefore, the aggregate can be caught or jammed in the compressed resilient tube 54, not only damaging the resilient tube 54 soon, but also causing a reduced transmitting efficiency of the slurry. Moreover, the cross-sectional shape of the resilient tube 54, as compressed by the squeeze rollers 57, would vary to be flat, causes a poor transmitting efficiency of the slurry.

Another problem with the squeeze pump described in U.S. Pat. No. 4,492,538 is that the squeeze rollers 57 pull the resilient tube 54 in the direction of revolution when the squeeze rollers 57 leave from the resilient tube 54. Therefore, such pulled portion, which is disposed within the casing 52, of the resilient tube 54 would become entirely smaller in diameter, reducing the transmitting efficiency of the slurry. Further, the resilient tube 54, when thus pulled, would be bent obliquely at its portion which is introduced into the casing 52, and as a result, such bent portion would be broken or damaged soon.

To this end, the present applicant disclosed, in Japanese Patent Laid-Open Publication (Tokkaisho) 58-158389, a squeeze pump such as shown in FIG. 12. In this squeeze pump, a regulating member 55 is mounted in the casing 52 along the arcuate resilient tube 54 for preventing the latter from moving toward the center of the casing 52. However, since the regulating member 55 extends along the entire portion of the resilient tube 54 which is disposed in the casing 52, the squeeze pump is expensive to manufacture.

SUMMARY OF THE INVENTION

It is an object of the present invention to provide a squeeze pump in which generation of heat of a resilient tube can be restrained without making the structure of roller shafts of squeeze rollers complex.

Another object of the invention is to provide a squeeze pump which enables an improved transmitting efficiency of slurry and in which a resilient tube can easily recover its original shape after compressed between squeeze rollers.

A further object of the invention is to provide a squeeze pump in which a resilient tube is stable in position in a casing to cause an improved transmitting efficiency of slurry and which can reduce manufacturing costs of a transmitting regulating member to a minimum.

According to a first aspect of the present invention, there is provided a squeeze pump comprising: a casing having an arcuate inner peripheral surface; a resilient tube bent arcuately in the casing and having opposite ends projecting outwardly from the casing through openings therein; a rotary shaft disposed in an axis of the casing; and at least a pair of squeezing means mounted on the rotary shaft in the casing, the squeezing means including a pair of roller shafts extending perpendicularly to the roller shaft, and a pair of squeeze rollers rotatably mounted on the respective roller shafts and rollable on opposite side surfaces of the resilient tube and revolvable at the same time about the rotary shaft for compressing the resilient tube from opposite sides thereof to transmit slurry in the casing, each of the squeeze rollers being divided along its axis into three independently rotatable roller sections, namely, a base end roller section constituting a base portion of the squeeze roller, a distal end roller section constituting a distal end portion of the squeeze roller, and an intermediate roller section constituting an intermediate portion between the base end roller section and the distal end roller section.

According to a second aspect of the present invention, a squeeze pump includes, in addition to the casing, the rotary shaft and the squeeze means, all of the first aspect of the invention, at least one pushing means for outwardly pushing back a bulged portion of the resilient tube inwardly swelled as the resilient tube is compressed between the squeeze rollers.

According to a third aspect of the present invention, a squeeze pump includes, in addition to the casing, the resilient tube, the rotary shaft and the squeezing means, all of the first aspect of the invention, restricting means for restricting the resilient tube from being pulled at its portion near the opening of the casing in the direction of revolution of the squeeze rollers when the latter leaves off the resilient tube after having compressed the same, said restricting means being provided at least on one of said openings without extending inwardly to said casing to a great extent.

Other objects and advantages will become apparent from the following description of an embodiment of the invention, when considered in connection with the accompanying drawings, and the novel features will be particularly pointed out in the appended claims.

DETAILED DESCRIPTION OF THE PREFERRED EMBODIMENTS

An embodiment of the present invention will be described hereinbelow in connection with FIGS. 1 through 7.

Figure 1:
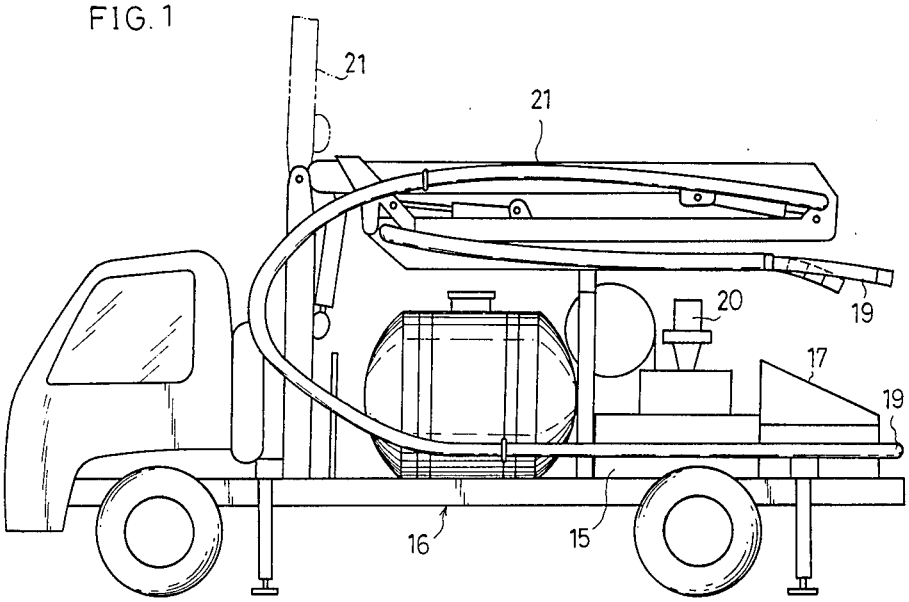
FIG. 1 is a schematic side elevational view of a concrete pump truck carrying a squeeze pump embodying the present invention.

As shown in FIG. 1, a squeeze pump 15 of this embodiment is carried on a concrete pump truck 16.

The squeeze pump 15 is driven, by a drive source 20 mounted thereon, for transmitting slurry such as concrete to an higher place through a transmitting pipe 19. The concrete slurry is thrown into a hopper 17, and for transmitting this concrete slurry therefrom to a higher place, the transmitting pipe 19 is extended by extending a boom 21 carried on the truck 16.

Figure 2:
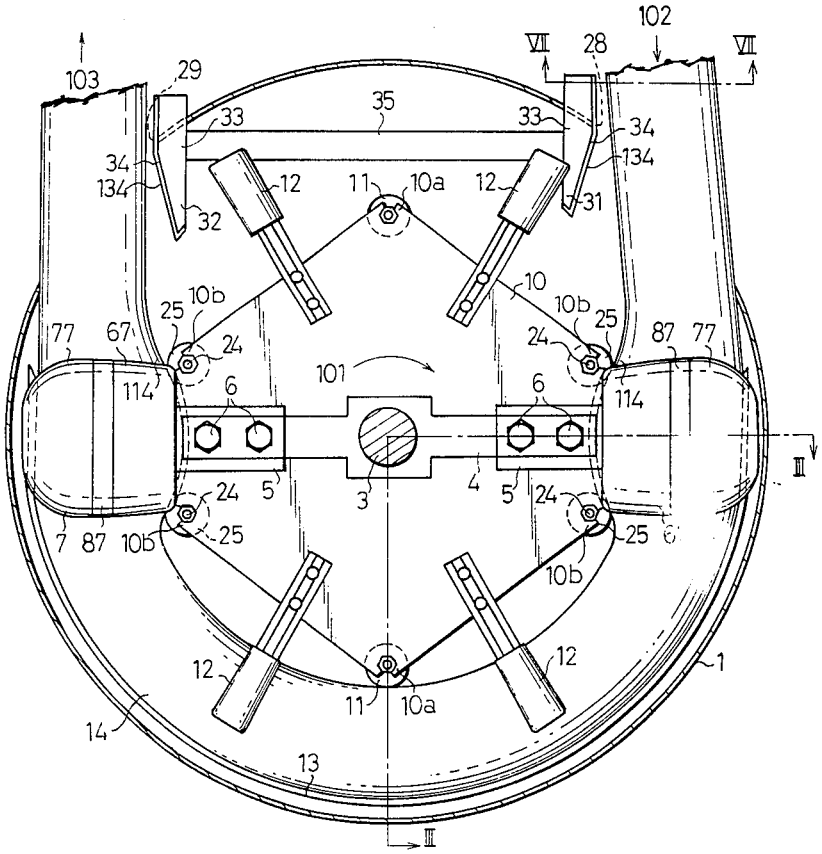
FIG. 2 is an enlarged fragmentary plan view, partially in cross section, of the squeeze pump of FIG. 1, illustrating the arrangement in which a resilient tube, squeeze rollers and pusher rollers are positioned in the casing.
Figure 3:
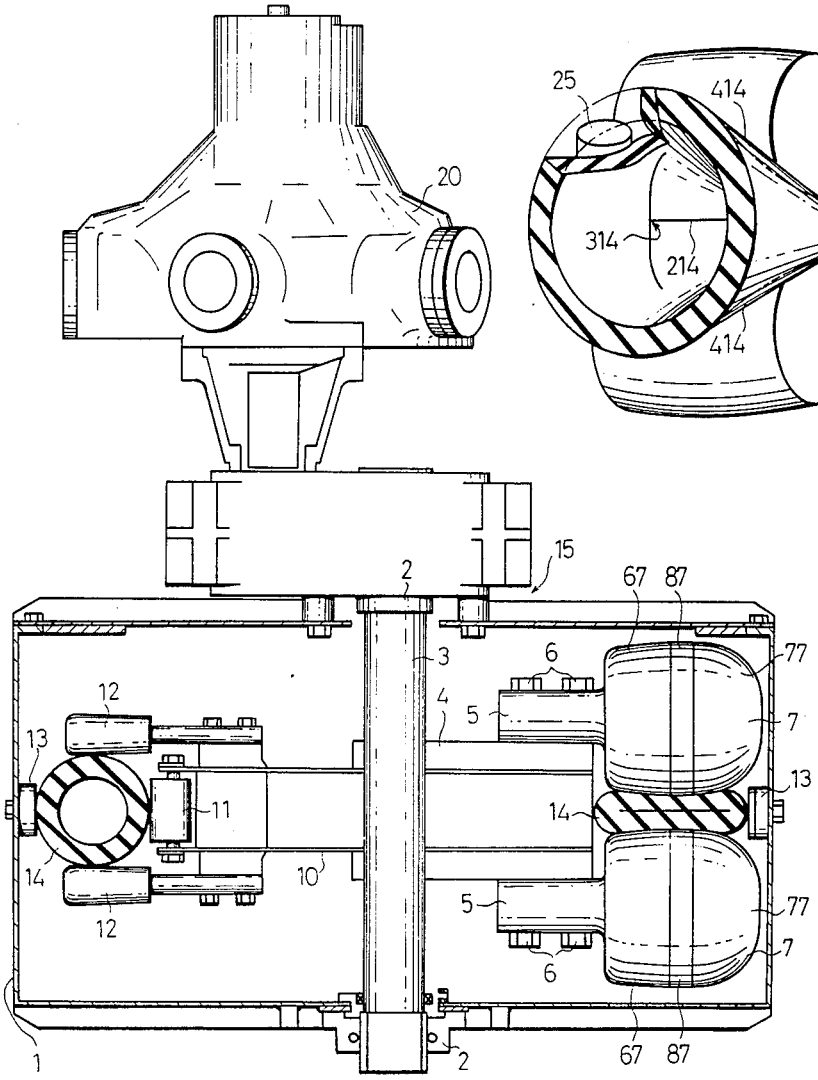
FIG. 3 is a cross-sectional view taken along line III—III of FIG. 2.

In the squeeze pump 15, as shown in FIGS. 2 and 3, a tubular casing 1 having a bottom and a closure is horizontally mounted, and a rotary shaft 3 is vertically supported by a pair of bearings 2 so as to disposed in the axis of the casing 1. Two arms 4 are fixedly secured at their base ends to the central portion of the rotary shaft 3 by welding, the other ends of these two arms 4 extending perpendicularly to the rotary shaft 3 and in opposite directions to each other.

Figure 4:
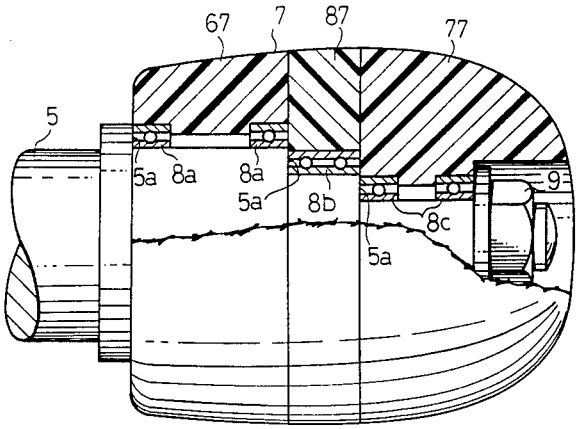
FIG. 4 is an enlarged side elevational view, partially broken away, of the individual squeeze roller.

A pair of roller shafts 5 are fixedly secured to upper and lower surfaces of the distal end portion of each arm 4 by means of screws, and a squeeze roller 7 of synthetic resin or metal is rotatably mounted on each roller shaft 5. As shown in FIG. 4, each of these squeeze rollers 7 is substantially cylindrical in entire shape, but bulging outwardly at its axially central portion. The purpose of this bulged central portion is to conform the peripheral surface of the individual squeeze roller 7 to the contour of a resilient tube (described below) when the latter is compressed between the squeeze rollers 7, at which time opposite side portions of the resilient tube are less depressed than at the central portion due to the resistance of the resilient tube.

Each squeezer roller 7 is axially divided into three sections, namely, a base end roller section 67, a distal end roller section 77, and an intermediate roller section 87 disposed between the base end roller section 67 and the distal end roller section 77. The base end roller section 67 and the distal end roller section 77 are larger in length than the intermediate roller section 87.

The base end roller section 67, the intermediate roller section 87 and the distal end roller section 77 are supported on the roller shaft 5 via a pair of bearings 8*a*, a bearing 8*b* and a pair of bearings 8*c*, respectively, so as to be rotatable indendently from one another. The roller shaft 5 has at its base end side steps 5*a* and is threaded at its distal end on which a nut 9 is mounted.

Figure 5:
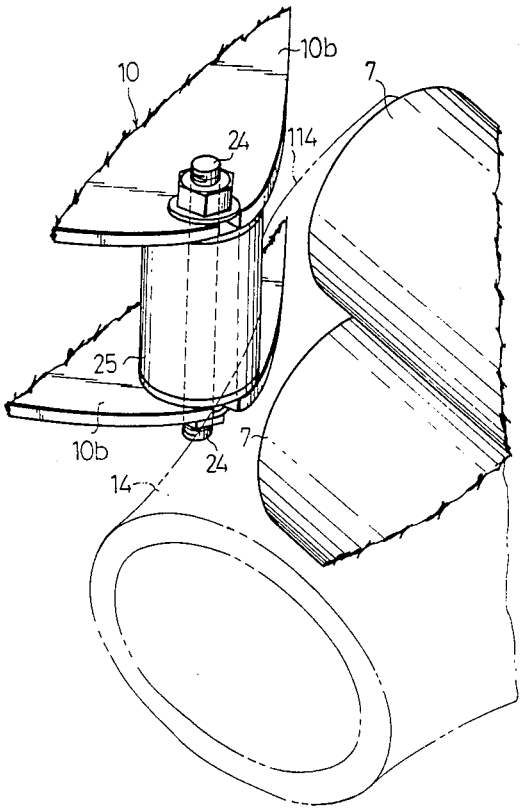
FIG. 5 is an enlarged perspective view illustrating the structure in which the individual pusher roller is mounted.

As shown in FIGS. 2 and 3, a pair of upper and lower support members 10 of generally hexagonal shape in plan is horizontally secured to the rotary shaft 3 centrally thereof and also to the two arms 4. A pair of recovery rollers 11 is pivotally mounted respectively at two corners 10*a*, out of six corners, of the support members 10 which two corners are angularly spaced from each arm 4 through an angle of 90° along the periphery of the support members 10. As shown in FIG. 5, four vertically extending roller shafts 24 are mounted respectively at four corners 10*b*, out of six corners, of the support members 10, said four corners are disposed near the squeeze rollers 7 forwardly and rearwardly thereof in the direction of revolution of the squeeze rollers 7. On each of the four roller shafts 24, a pusher roller 25 is supported so as to extend parallel to the rotary shaft 3. These four pusher rollers 25 are engageable with inner side peripheral bulged portions 114 of the resilient tube 14 to push the same outwardly, which portion is formed when the resilient tube 14 is compressed by the squeeze rollers 7.

A pair of upper and lower guide rollers 12 is rotatably mounted on the support members 10 at each of four positions between the individual pusher roller 25 and the individual recovery roller 11.

An arcuate guide rail 13 is secured to the inner peripheral surface of the casing 1 and extends centrally therealong. Placed inwardly of the guide rail 13 is an arcuately bent resilient tube 14 with its opposite ends projecting outwardly from the casing 1 through an inlet opening 28 and an outlet opening 29. As shown in FIG. 3, the resilient tube 14 is supported by two pairs of the squeeze rollers 7 in such a state that the resilient tube 14 is compressed from its upper and lower sides.

The resilient tube 14 is also supported by four pairs of the guide rollers 12 in such a state that the resilient tube 14 is slightly compressed from its upper and lower sides. Further, the resilient tube 14 is restricted on its inner peripheral side by the recovery rollers 11 so as not to be moved toward the rotary shaft 3.

Figure 7:
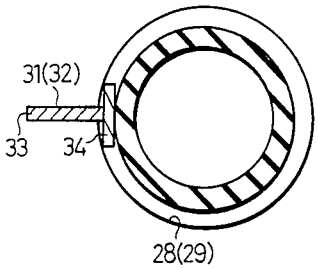
FIG. 7 is an enlarged cross-sectional view taken along line VII—VII of FIG. 2.
Figure 8:
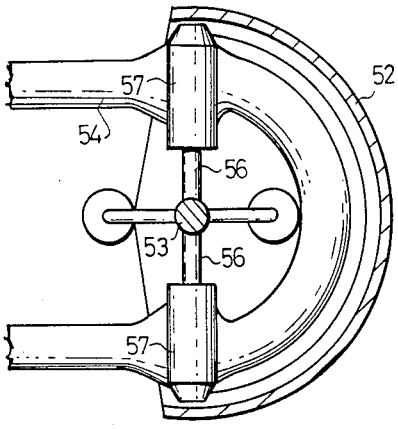
FIG. 8 is a cross-sectional view of a squeeze pump as viewed from the front disclosed in U.S. Pat. No. 4,492,538.
Figure 9:
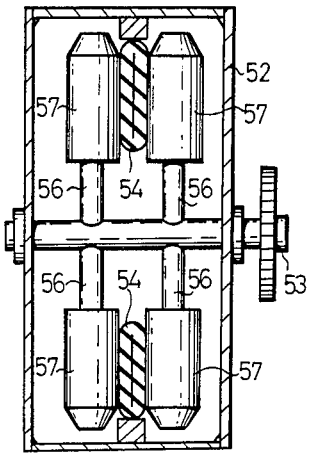
FIG. 9 is a cross-sectional view of the squeeze pump as viewed from the side disclosed in U.S. Pat. No. 4,492,538.
Figure 10:
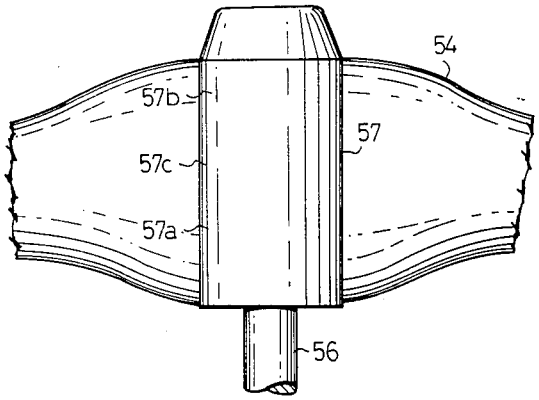
FIGS. 10 and 11 are fragmentary enlarged front and perspective views, respectively, illustrating the manner in which the resilient tube is compressed by the squeeze rollers according to the squeeze pump disclosed in U.S. Pat. No. 4,492,538.
Figure 11:
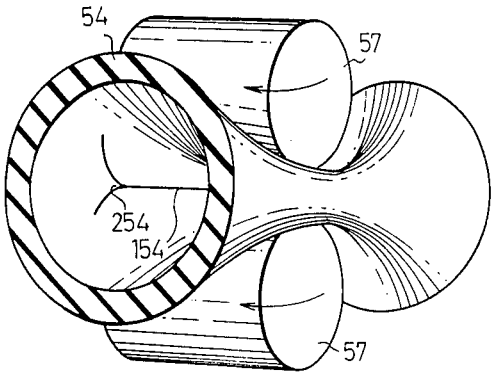
Figure 12:
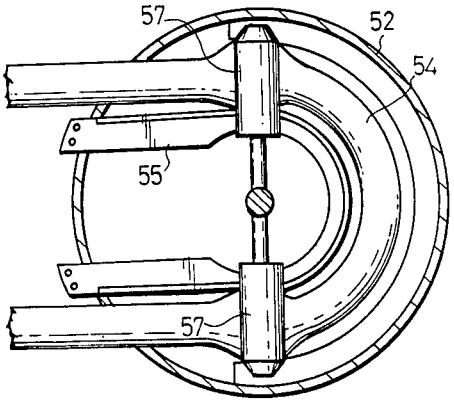
FIG. 12 is a cross-sectional view similar to FIG. 8, illustrating another squeeze pump having a restriction member in the casing disclosed in Japanese Patent Laid-open Publication 58-158389.

A pair of restriction members 31, 32 is mounted at the inlet and outlet openings 28, 29, respectively, of the casing 1. The restriction members 31, 32 are fixedly secured at their outer ends to the outer surface of the casing 1, with their inner ends projecting into the casing 1 to not a great extent. As shown in FIG. 7, each restriction member 31, 32 is composed of a horizontal attaching portion 33, and a supporting portion 34 secured to the attaching portion 33 perpendicularly thereto and disposed in the respective (inlet or outlet) opening 28, 29, thus jointly having an inverted T-shaped cross section. Further, the supporting portion 34 of each restriction member 31, 32 has an inclined surface 134 slanting from near a midpoint of the supporting portion 34 to an inner end thereof so as to lie along the surface of the bulged portion 114 of the resilient tube 14 formed when the latter is compressed by the squeeze rollers 7. In order for stronger attachment to the casing 1, the two restriction members 31, 32 are interconnected by a reinforcing member 35 (FIG. 2) in the form of a rod.

Each squeeze roller 7 is mounted on the respective roller shaft 5 in the following manner. Firstly, one bearing **8*a* is attached to the base end side of the roller shaft 5, and then the base end roller section 67 is threaded on the roller shaft 5, whereupon another bearing 8*a* is attached to the roller shaft 5. Secondly, a bearing 8*b* smaller in inside diameter than the bearings 8*a* is attached to the roller shaft 5, and then the intermediate roller section 87 is mounted on the bearing 8*b*. Further, one bearing 8*c* is attached to the distal end of the roller shaft 5, and then the distal end roller section 77 is threaded on the roller shaft 5, whereupon another bearing 8*c* is attached to the roller shaft 5. Finally, the nut 9 is threadedly mounted on the distal end of the roller shaft 5. As a result, the individual squeeze roller 7 has been completely assembled on the roller shaft 5**.

The operation and advantageous results of the squeeze pump thus constructed will be described hereinbelow.

As the rotary shaft 3 of the squeeze pump 15 is rotated in the direction of an arrow 101 in FIG. 2 upon start of the drive source 20, the two arms 4, together with the support members 10 and the roller shafts 5 secured to the distal ends of the arms 4, are turned about the rotary shaft 3. This causes two pairs of the squeeze rollers 7 revolve about the rotary shaft 3, during which time the squeeze rollers 7 roll on upper and lower surfaces of the resilient tube 14 to compress the latter from its upper and lower sides as shown in FIG. 3.

With the squeeze rollers 7 thus rolling on the resilient tube 14 to compress the latter, when an amount of slurry containing aggregate mixed in mortar is supplied from the hopper 17 to one open end of the resilient tube 14 to flow in the direction of an arrow 102 in FIG. 2, the slurry is transmitted in the direction of an arrow 103 as it is forced progressively forwardly by the two pairs of squeeze rollers 7.

Each squeeze roller 7 is divided into three sections, namely, the base end roller section 67, the intermediate roller section 77 and the distal end roller section 87 so that they are rotatable independently from one another. Therefore, as the individual squeeze roller 7 rolls, the three roller sections 67, 77 87 roll at different peripheral speeds so that the distal end roller section 77 is rotatable at a peripheral speed higher than the base end roller section 67.

Using the thus divided squeeze rollers 7 according to this embodiment, unlike the conventional non-divided squeeze rollers, it is possible to minimize the occurrence of slipping between the squeeze roller 7 and the resilient tube 14, thus causing a sharply prolonged life of the resilient tube 14.

During the time of transmitting the slurry, the individual recovery rollers 11 serves not only to recover the flattened or deformed portion of the resilient tube 14, but to prevent the resilient tube 14 from being moved toward the rotary shaft 3.

The guide rollers 12 serve to prevent the resilient tube 14 from being displaced vertically in the casing 1.

Figure 6:
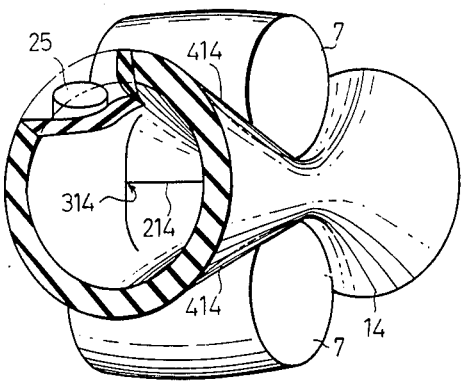
FIG. 6 is a fragmentary perspective view of the resilient tube compressed by a pair of the squeeze rollers.

During that time, the pusher rollers 25 also contact with two bulged portions 114 of the resilient tube 14 which portions are formed at the inner peripheral side of the tube 14 as the latter is compressed by the squeeze rollers 7. These pusher rollers 25 freely roll along the bulged portions 114 to push them back outwardly, as shown in FIGS. 5 and 6. Therefore, aggregate in the slurry is hard to be caught in the corner 314 of the valley 214. Even in the event that the aggregate is caught in the corner 314, it can be easily forced forwardly, minimizing the jamming of the aggregate between the inside surfaces of the resilient tube 14 and hence causing an improved efficiency of transmitting slurry.

When the bulged portions 114 are thus pushed, the upper and lower portions 414 of the resilient tube 14 slightly swell from the dash-and-two-dot-line position to the solid-line position, as shown in FIG. 6. As a result, the angle of the valley 214 defined by the upper and lower inside surfaces of the resilient tube 14 becomes larger to allow the aggregate to be forced ahead the squeeze rollers 7, thus improving the efficiency of transmitting the slurry.

Also, the pusher rollers 25 disposed rearwardly in the direction of revolution of the squeeze rollers 7 serve to recover the cross-sectional shape of the resilient tube 14 from oval to circle by pushing the bulged portions 114.

Upon operation of the squeeze pump, when leaving off the resilient tube 14, each pair of the squeeze rollers 7 acts on the resilient tube 14 so as to strongly pull the same in the direction of revolution. In such event, according to the present embodiment, the resilient tube 14 is supported by the supporting portion 34 of the restriction member 32 near the outlet opening 29 of the casing 1. Particularly because the inclined surface 134 of the supporting portion 34 slants so as to lie along the surface of the bulged portion 14 of the resilient tube 14, displacement of the resilient tube 14 can be prevented with sureness. Consequently, upon termination of the compression, the finally compressed portion of the resilient tube 14 is restricted from moving in the direction of revolution of the squeeze rollers 7 and is hence kept as it originally is; that is, the resilient tube 14 is not subjected to change in position. Also, deterioration of the resilient tube 14 due to the pulling force in the direction of revolution of the squeeze rollers 7 can be reduced.

Upon start of the compression, the resilient tube 14 is subjected to the force in the direction of revolution of the squeeze rollers 7 and the force in the direction of the inner periphery of the casing 1, at which time the initially compressed portion of the resilient tube 14 is prevented by the casing 1 from being displaced near the inlet opening 28 of the casing 1; that is, the resilient tube 14 is not subjected to change in position.

In the squeeze pump, for the purpose of returning the slurry in the resilient tube 14 to the hopper 17 upon termination of the transmitting operation, the rotary shaft 3 is driven in the direction opposite to that of the arrow 101 to cause the squeeze rollers 7 to revolve reversely. And compression of the resilient tube 14 by the squeeze rollers 7 terminates at the inlet opening 28 of the casing 1. At that time the restriction member 31 near the inlet opening 28, like the restriction member 32 near the outlet opening 29 is engageable with the resilient tube 14 to prevent the same from displacement.

Also, during the time squeeze pump is assembled and for the purpose of replacing the worn resilient tube 14 with a new one, the squeeze rollers 7 is rotated reversely. At that time one end of the resilient tube 14 is inserted into the casing 1 from the outlet opening 29, while the squeeze rollers are kept in reverse rotation. This end of the resilient tube 14 is thus guided toward the inlet opening 28 along the inner periphery of the casing 1, and is then directed outwardly of the casing 1 from the inlet opening 28 along the inclined surface 134 of the restriction member 31 upon arrival at the inlet opening 28. Thus the end of the resilient tube 14 can be directed outwardly from the inlet opening 28 smoothly without making a complete revolution along the inner periphery of the casing 1.

Since these two restriction member 31, 32 are of the same shape, they can be manufactured with ease.

The present invention is not limited to the foregoing embodiment, but may be carried out in the following modifications:

(1) The squeeze pump 15 is carried on a movable base other than the truck 16.

(2) The squeeze pump 15 is placed vertically, not horizontally.

(3) The base end, distal end and intermediate roller sections 67, 77 and 87 of each squeeze roller 7 are substantially identical in axial length.

(4) The roller shafts 5 are mounted directly on the rotary shaft 3 with the arms 4 omitted.

(5) The individual squeeze rollers 7 have a perfect cylindrical shape.

It will be understood that various changes in the details, material, and arrangements of parts, which have been herein described and illustrated in order to explain the nature of the invention, may be made by those skilled in the art within the principle and scape of the invention as expressed in the appended claims.

What is claimed is:

1. A squeeze pump comprising:

(a) a casing (1) having an arcuate inner peripheral surface;

(b) a resilient tube (14) bent arcuately in said casing (1) and having opposite ends projecting outwardly from said casing (1) through openings (28),(29) therein;

(c) a rotary shaft (3) disposed in an axis of said casing (1); and (d) at least a pair of squeezing means mounted on said rotary shaft (3) in said casing (1), said squeezing means including a pair of roller shafts (5) extending perpendicularly to said rotary shaft (3), and a pair of squeeze rollers (7) rotatably mounted on the respective roller shafts (5) and rollable on opposite side surfaces of said resilient tube (14) and revolvable at the same time about said rotary shaft (3) for compressing said resilient tube (14) from opposite sides thereof to transmit slurry in said casing (1), each of said squeeze rollers (7) being divided along its axis into three independently rotatable roller sections, namely, a base end roller section (67) constituting a base portion of said squeeze roller (7), a distal end roller section (77) constituting a distal end portion of said squeeze roller (7), and an intermediate roller section (87) constituting an intermediate portion between said base end roller section (67) and said distal end roller section (77).

2. A squeeze pump according to claim 1, wherein each said squeeze roller (7) has an outwardly bulged portion engageable with said resilient tube (14).

3. A squeeze pump according to claim 1, wherein said casing (1) is horizontally mounted.

4. A squeeze pump according to claim 1, wherein said roller shaft (5) has a plurality of bearings **(8*a*), (8*b*), (8*c*) for supporting said base end roller section (67), said intermediate roller section (87) and said distal end roller section (77), respectively, said base end roller section (67) and said distal end roller section (77) being larger in axial length than said intermediate roller section (87)**.

5. A squeeze pump comprising:

(a) a casing (1) having an arcuate inner peripheral surface;

(b) a resilient tube (14) bent arcuately in said casing (1) and having opposite ends projecting outwardly from said casing (1) through openings (28), (29) therein;

(c) a rotary shaft (3) disposed in an axis of said casing (1);

(d) at least a pair of squeezing means mounted on said rotary shaft (3) in said casing (1), said squeezing means including a pair of roller shafts (5) extending perpendicularly to said rotary shaft (3), and a pair of squeeze rollers (7) rotatably mounted on the respective roller shafts (5) and rollable on opposite side surfaces of said resilient tube (14) and revolvable at the same time about rotary shaft (3) for compressing said resilient tube (14) from opposite sides thereof to transmit slurry in said casing (1); and (e) at least one pushing means for outwardly pushing back a bulged portion (114) of said resilient tube (14) inwardly swelled as said resilient tube (14) is compressed between said squeeze rollers (5), said pushing means including a pair of pusher rollers (25) disposed immediately near said squeeze rollers (7) forwardly and rearwardly in the direction of revolution thereof and engageable with a bulged portion (114) of said resilient tube.

6. A squeeze pump according to claim 5, wherein said rotary shaft (3) of said casing (1) has a support member (10) rotatable as a unit with said rotary shaft (3) and supporting said pusher rollers (25) in such a manner that the latter extend parallel to said rotary shaft (3) and are rotatable thereon.

7. A squeeze pump comprising:

(a) a casing (1) having an arcuate inner peripheral surface;

(b) a resilient tube (14) bent arcuately in said casing (1) and having opposite ends projecting outwardly from said casing (1) through openings (28), (29) therein;

(c) a rotary shaft (3) disposed in an axis of said casing (1);

(d) at least a pair of squeezing means mounted on said rotary shaft (3) in said casing (1), said squeezing means including a pair of roller shafts (5) extending perpendicularly to said rotary shaft (3), and a pair of squeeze rollers (7) rotatably mounted on the respective roller shafts (5) and rollable on opposite side surfaces of said resilient tube (14) and revolvable at the same time about rotary shaft (3) for compressing said resilient tube (14) from opposite sides thereof to transmit slurry in said casing (1); and (e) restricting means for restricting said resilient tube (14) from being pulled at its portion near said openings (28),(29) of said casing (1) in the direction of revolution of said squeeze rollers (7) when the latter leave off said resilient tube (14) after having compressed the same, said restricting means being provided at least on one of said openings (28),(29) without extending inwardly to said casing (1) to a great extent, said restricting means including a pair of restriction members (31),(32) disposed near said inlet opening (28) and said outlet opening (29), respectively, each of said restriction members (31),(32) having a supporting portion (34) engageable with said resilient tube (14), said supporting portion (34) of one of said restriction members (32) near said outlet opening (29) having an inclined surface (134) slanting inwardly so as to lie along a bulged portion (134) of said resilient tube (14) which portion is formed on an inner peripheral side of said resilient tube (14) when the latter is compressed by said squeeze rollers (7).

* * * * *